US008126181B2

(12) United States Patent
Yamamoto et al.

(10) Patent No.: US 8,126,181 B2
(45) Date of Patent: Feb. 28, 2012

(54) ACOUSTIC SYSTEM

(75) Inventors: Yoshinori Yamamoto, Kanagawa (JP); Akihito Moriya, Kanagawa (JP); Yutaka Sato, Kanagawa (JP); Osamu Takahashi, Chiba (JP); Toshimasa Takahashi, Tokyo (JP)

(73) Assignee: Sony Corporation, Tokyo (JP)

( * ) Notice: Subject to any disclaimer, the term of this patent is extended or adjusted under 35 U.S.C. 154(b) by 1076 days.

(21) Appl. No.: 11/341,432

(22) Filed: Jan. 30, 2006

(65) Prior Publication Data

US 2007/0087784 A1 Apr. 19, 2007

(30) Foreign Application Priority Data

Oct. 13, 2005 (JP) ..... 2005-299188

(51) Int. Cl.
*H04R 1/02* (2006.01)
*H04R 9/06* (2006.01)

(52) U.S. Cl. ..... 381/333; 455/573

(58) Field of Classification Search ..... 700/94; 381/306, 28, 333, 388, 122; 455/344, 346, 455/347, 350, 575.1, 569.1, 563, 567
See application file for complete search history.

(56) References Cited

U.S. PATENT DOCUMENTS 5,987,106 A * 11/1999 Kitamura ..... 379/110.01
6,233,343 B1 * 5/2001 Muranami et al. ..... 381/96
6,885,900 B1 * 4/2005 Rybicki et al. ..... 700/94
6,954,652 B1 * 10/2005 Sakanashi ..... 455/550.1
7,624,259 B2 * 11/2009 Bear et al. ..... 381/104
2001/0021659 A1 * 9/2001 Okamura ..... 455/557
2003/0040344 A1 * 2/2003 Shteyn et al. ..... 455/573
2005/0288067 A1 * 12/2005 Wainwright ..... 455/567

FOREIGN PATENT DOCUMENTS

| | | |
|---|---|---|
| EP | 0 907 122 A1 | 4/1999 |
| GB | 2 296 157 A | 6/1996 |
| JP | 11-168790 | 6/1999 |
| JP | 2000-217099 | 8/2000 |
| JP | 2003-79061 | 3/2003 |
| JP | 2003-283609 | 10/2003 |
| JP | 2005-191651 | 7/2005 |
| WO | WO 03/079650 A1 | 9/2003 |

OTHER PUBLICATIONS

Office Action issued Dec. 13, 2010, in European Patent Application No. 06 002 006.2-2225.
Medion MD 42200 Wireless Multimedia Entertainment Notebook User Manual, 8 pages, 2004.

* cited by examiner

*Primary Examiner* — Ping Lee
(74) *Attorney, Agent, or Firm* — Oblon, Spivak, McClelland, Maier & Neustadt, L.L.P.

(57) ABSTRACT

In addition to output the mid-high range audio sound from the speakers of the main unit, the present invention can output the low range audio sound according to the audio signal transmitted from the main unit through the DC power supply transmission cable from the sub-woofer unit of the AC adapter. Accordingly, the present invention can provide a richly expressive acoustic space without enlarging the size of the main unit.

13 Claims, 6 Drawing Sheets

ACOUSTIC SYSTEM

CROSS REFERENCE TO RELATED APPLICATIONS

The present invention contains subject matter related to Japanese Patent Application JP 2005-299188 filed in the Japanese Patent Office on Oct. 13, 2005, the entire contents of which being incorporated herein by reference.

BACKGROUND OF THE INVENTION

1. Field of the Invention

This invention relates to an acoustic system applicable to a portable telephone system which outputs music with high-quality reproduced from a portable telephone connected to, for example, a cradle.

2. Description of the Related Art

A portable telephone system in which a portable telephone terminal is mounted on a charging stand as a main unit for charging through a charging terminal of the charging stand, and is adapted to output an audio sound obtained by reproducing music data by the portable telephone terminal from a speaker of charging stand built in the charging stand (for example, refer to Jpn. Pat. Appln. Laid-Open Publication No. 2003-283609).

SUMMARY OF THE INVENTION

However, in a portable telephone system of such a configuration, the size of the charging stand speaker is restricted in accordance with the miniaturization of the charging stand which mounts the portable telephone terminal. For this reason, it has been difficult to enlarge the diameter of cone paper in the charging stand speaker. Therefore, there is a problem that a low range audio sound outputted from the charging stand speaker is insufficient.

The present invention has been made in consideration of the above-mentioned points. This invention provides an acoustic system which can provide a richly expressive acoustic space without enlarging the size of a main unit.

An acoustic system of the present invention to solve such a problem comprises a power supply adapter carrying a woofer unit which outputs a low range audio sound according to an audio signal, a main unit carrying speaker units which output a mid-high range audio sound according to the audio signal, and a transmission cable which connects the power supply adapter to the main unit and transmits the audio signal to the power supply adapter from the main unit to output the low range audio sound from the woofer unit.

Therefore, this acoustic system outputs the mid-high range audio sound according to the audio signal from the speaker units of the main unit, and further the low range audio sound according to the audio signal transmitted from the main unit through a transmission cable from the woofer unit of the power supply adapter. Accordingly, a richly expressive acoustic space can be provided without enlarging the size of the main unit.

According to one embodiment of the present invention, in addition to output the mid-high range audio sound of the audio signal from the speaker units of the main unit, the present invention can output the low range audio sound of the audio signal transmitted from the main unit through the transmission cable can be outputted from the woofer unit of the AC adapter. Accordingly, the acoustic system which can provide a richly expressive acoustic space can be realized without enlarging the size of the main unit.

The nature, principle and utility of the invention will become more apparent from the following detailed description when read in conjunction with the accompanying drawings in which like parts are designate by like reference numerals or characters.

DETAILED DESCRIPTION OF THE PREFERRED EMBODIMENTS

Hereinafter, an embodiment of the present invention will be described in detail with reference to the drawings.

(1) Overall Structure of Acoustic System

Figure 1:
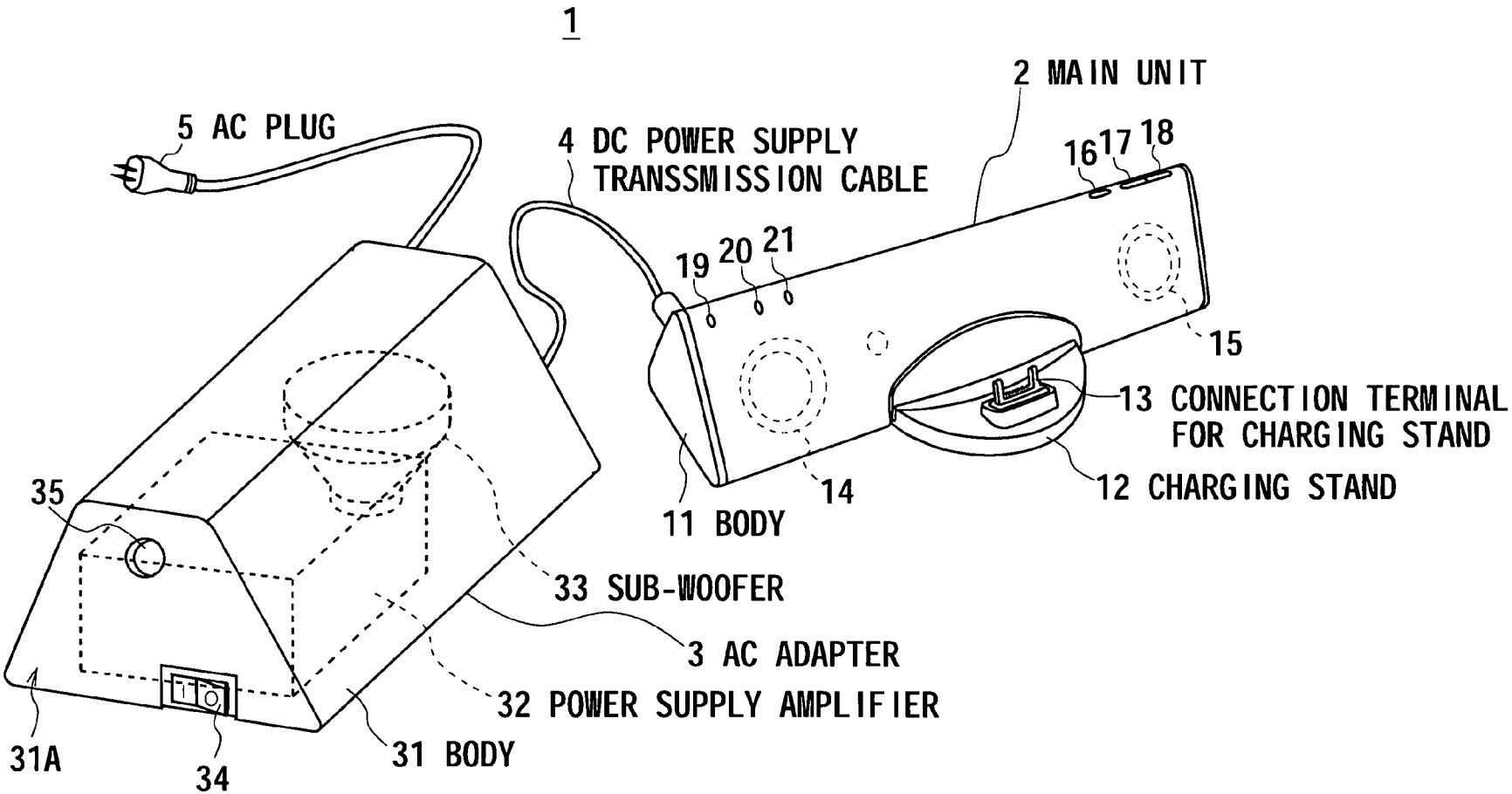
FIG. 1 is a schematic perspective view showing an overall configuration of an acoustic system of the present invention.

In FIG. 1, reference numeral 1 shows an acoustic system of 2.1 channel of the present invention as a whole. The acoustic system comprises a main unit 2 for charging a portable telephone with music reproducing function (to be described later), an Alternating Current (AC) adapter 3 for supplying a Direct Current (DC) power of predetermined voltage level to the main unit 2, and a DC power transmission cable 4 for connecting the main unit 2 and the AC adapter 3.

The AC adapter 3 is adapted to operate the main unit 2 by converting a voltage of AC100 V supplied from an AC plug 5 connected to a commercial AC power supply (not shown) into a voltage of DC12 V and supplying the DC power of the DC12 V to the main unit 2 through the DC power supply transmission cable 4.

(2) External Structure of Main Unit

Figure 2:
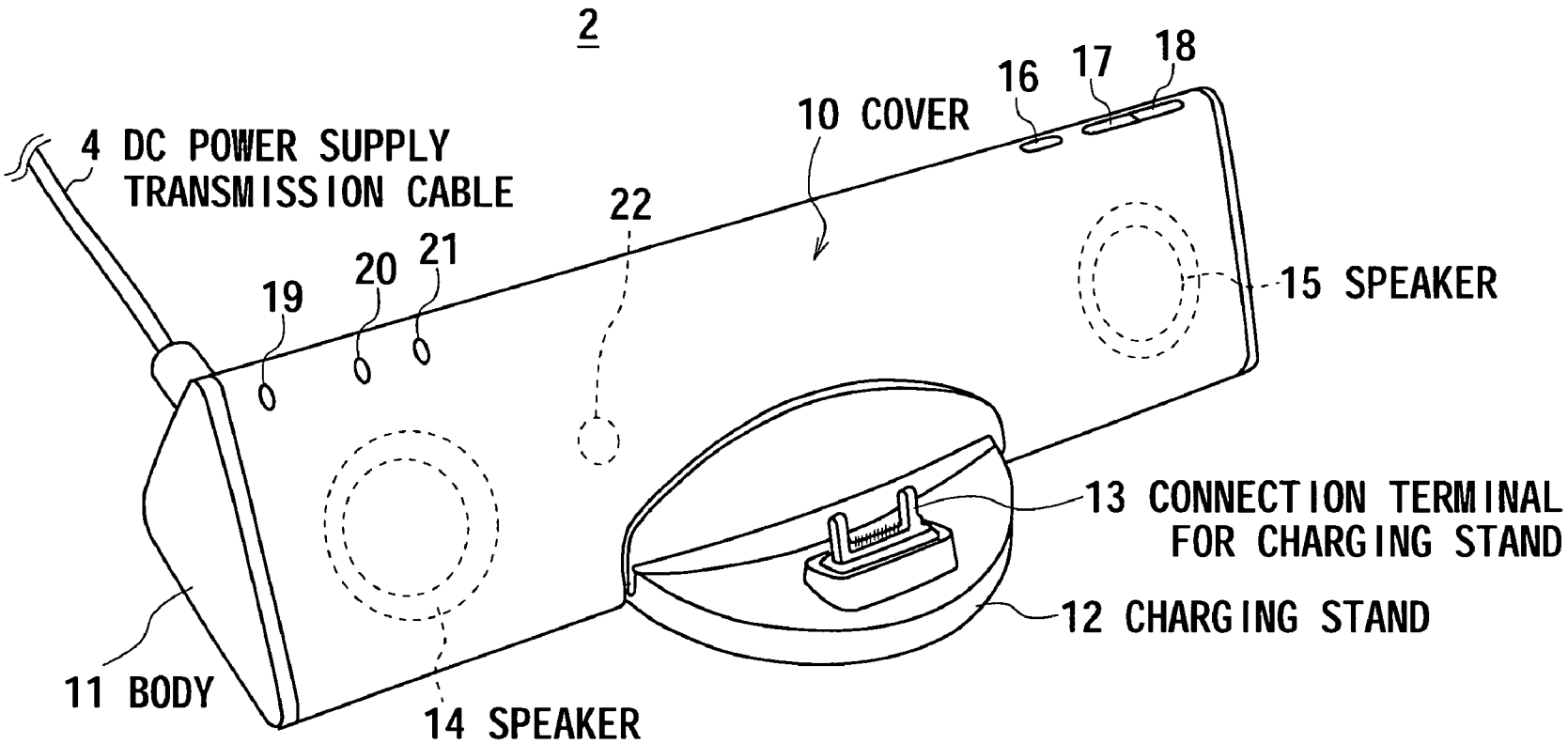
FIG. 2 is a schematic perspective view showing a front surface structure of a main unit.

As shown in FIG. 2, the main unit 2 has a body 11 having a triangular prism shape. A charging stand 12 having a half-circular thin plate shape is projected from the substantially central portion of the body 11 in a longitudinal direction. A connection terminal for charging stand 13 or electrically connecting the connection terminal for the terminal of the portable telephone with music reproducing function (to be described later) is provided to the charging stand 12.

Further, the main unit 2 has a left speaker 14 and a right speaker 15 which mainly output mid-high range audio sound, provided at both sides of the charging stand 12. A cover 10 made of metal having lattice-shape pores, is attached to cover and conceal the left speaker 14 and the right speaker 15 in the main unit 2.

Furthermore, the main unit 2 has a function switch 16 provided at the right side upper end of the body 11, a volume up button 17 and a volume down button 18 provided adjacent to the function switch 16, a power display Light Emitting Diode (LED) 19 showing a power on state, provided at the left side upper end of the body 11, a line-in display LED 20 showing the connection of an external electronic apparatus through a line input terminal (to be described later), and a surround display LED 21 showing that a surround function becomes on state through an infrared remote controller (not shown).

Incidentally, the main unit 2 has a light receiver 22 for the infrared remote controller, provided in the inside of the cover 10. A control command from the infrared remote controller is received by the light receiver 22 and the above-mentioned surround function is adapted to be turned on based on the control command.

Figure 3:
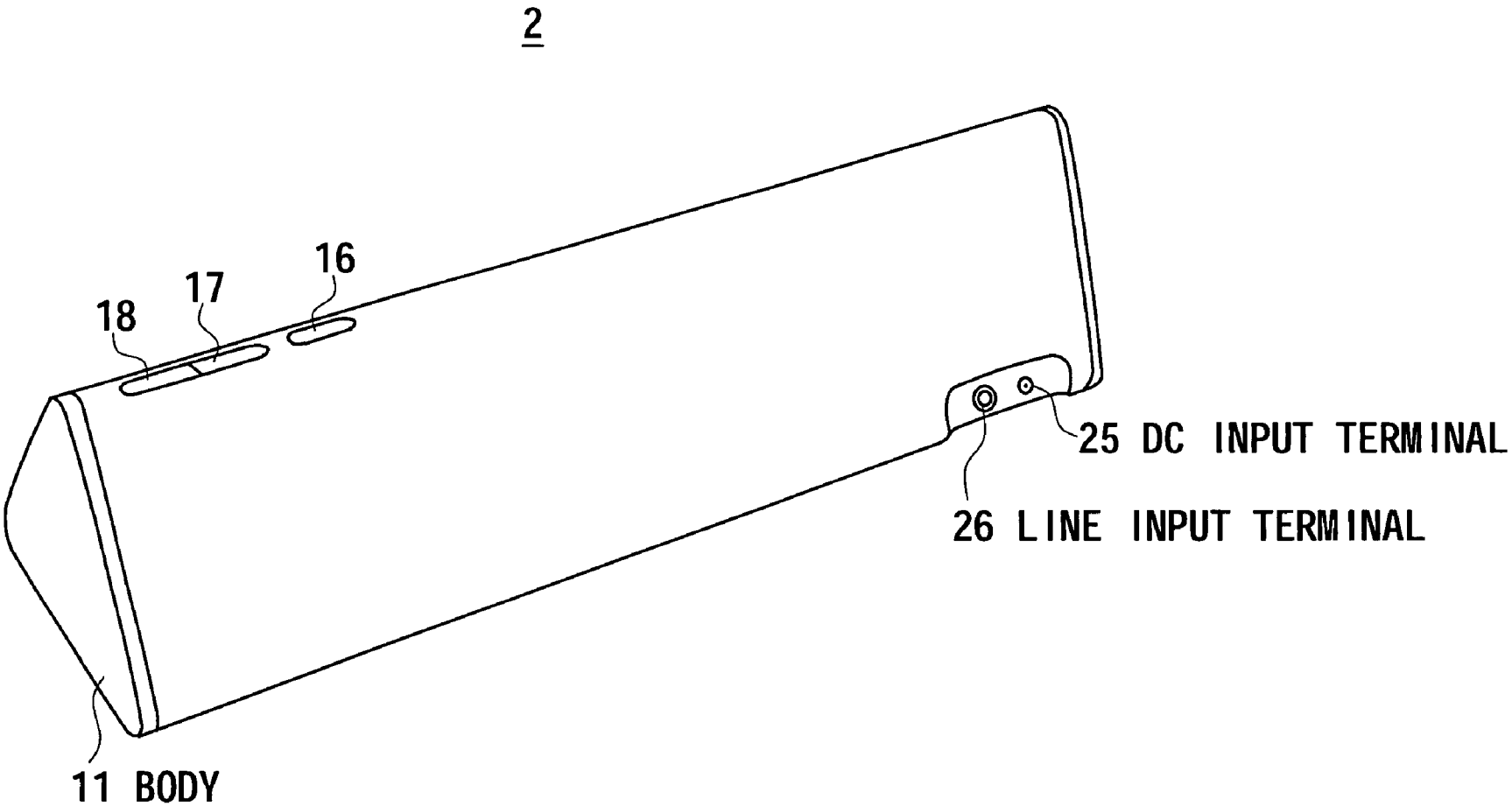
FIG. 3 is a schematic perspective view showing a back surface structure of the main unit.

On the other hand, as shown in FIG. 3, the main unit 2 has a DC input terminal 25 for receiving the supply of the DC power of DC12 V from the AC adapter 3 through the DC power supply transmission cable 4 at the right side lower end of the back surface of the body 11. The main unit 2 also has a line input terminal 26 for inputting the music signal from the external electronic apparatus (not shown) adjacent to the DC input terminal 25.

Figure 4:
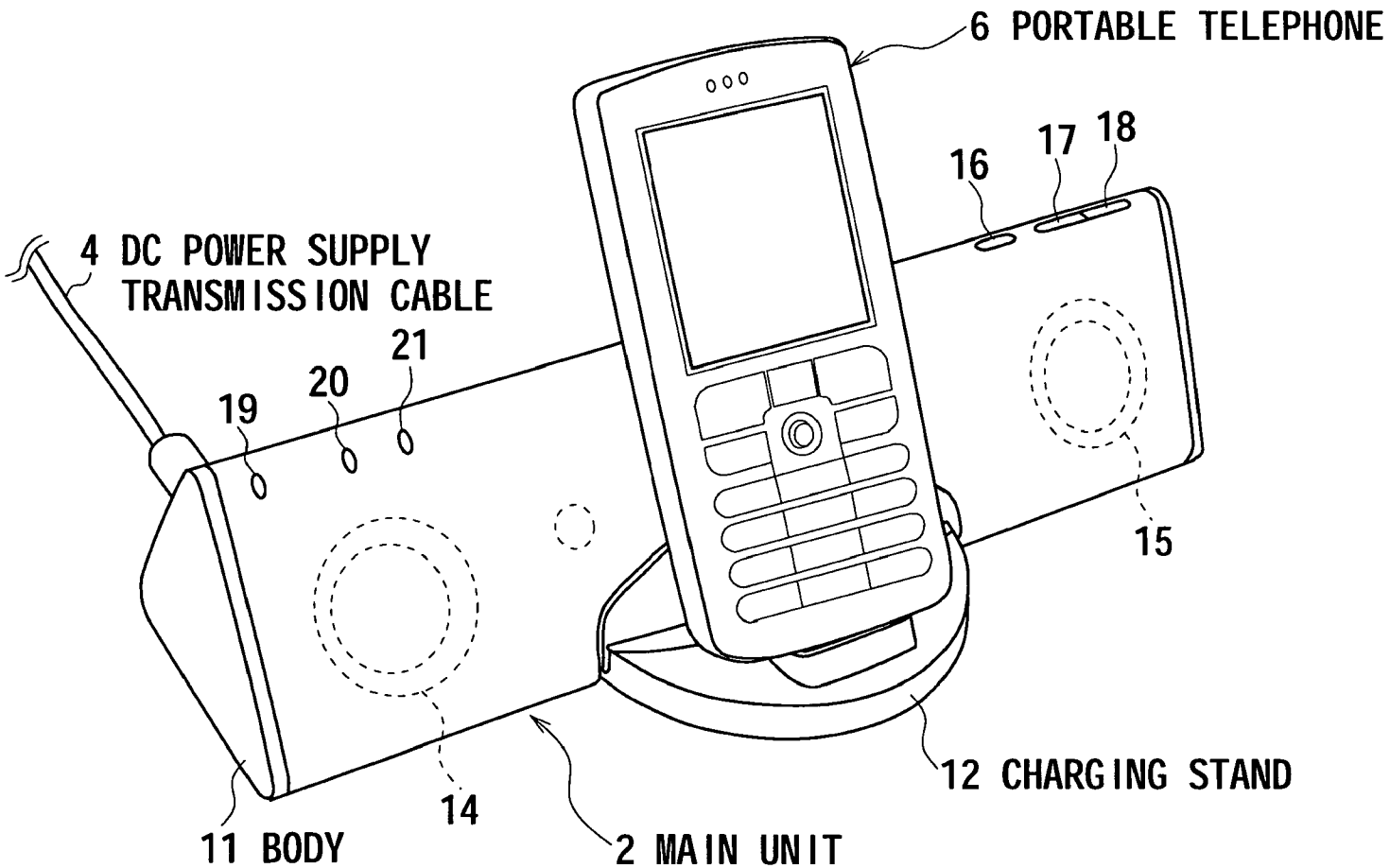
FIG. 4 is a schematic perspective view showing a charging state of a portable telephone with music reproducing function.

Therefore, as shown in FIG. 4, when the portable telephone with music reproducing function 6 is mounted on a connection terminal for charging stand 13 (not shown) of the charging stand 12 in the state that the main unit 2 receives the supply of the DC power of the DC12 V from the AC adapter 3 through the DC power supply transmission cable 4, the connection terminal for charging stand 13 is electrically connected to the connection terminal for charger (not shown), provided at the lower end of the portable telephone with music reproducing function 6, and then charging is started.

Incidentally, when the connection terminal for terminal of the portable telephone with music reproducing function 6 is electrically connected to the connection terminal for charging stand 13 of the charging stand 12, the main unit 2 inputs the music signal reproduced from an internal memory by the portable telephone with music reproducing function 6 through the connection terminal for charging stand 13, and outputs the sounds based on the music signal from the left speaker 14 and the right speaker 15.

(3) External Structure of AC Adapter

Incidentally, the AC adapter 3 (FIG. 1) is composed of a body 31 having a quadrangular prism shape that shows a trapezoidal cross section. The AC adapter 3 has a power amplifier 32 and a sub-woofer 33 in the inside thereof.

The AC adapter 3 has a power switch 34 provided on a front surface 31A of the body 31 to switch on/off of a power supply. The AC adapter 3 also has a port 35 for the sub-woofer 33 concealed in the inside of the body 31. The low range audio sound outputted from the sub-woofer 33 is outputted from the port 35 in the state that the low range audio sound is increased to a higher pitch. Thus, the low range audio sound is supplemented to the mid-high range audio sound outputted from the left speaker 14 and the right speaker 15 of the main unit 2.

As described above, the AC adapter 3 need to cover the low range audio sound only by the sub-woofer 33 but does not need to output the mid-high range audio sound. Accordingly, the AC adapter 3 can be formed in a concealing structure which does not expose the sub-woofer 33 from the front surface of the body 31 to the exterior. Thus, a user does not sense that the sub-woofer 33 is built in the AC adapter 3.

Incidentally, the AC adapter 3 is composed of a speaker unit of so-called a Kelton type that the front surface of the woofer of the sub-woofer 33 is concealed by the body 31. However, the AC adapter 3 is not limited to the Kelton type and the other types of speaker unit, such as a bass-reflex type, a double bass-reflex type, etc., may constitute the AC adapter 3.

(4) Circuit Structure of Main Unit and AC Adapter

Figure 5:
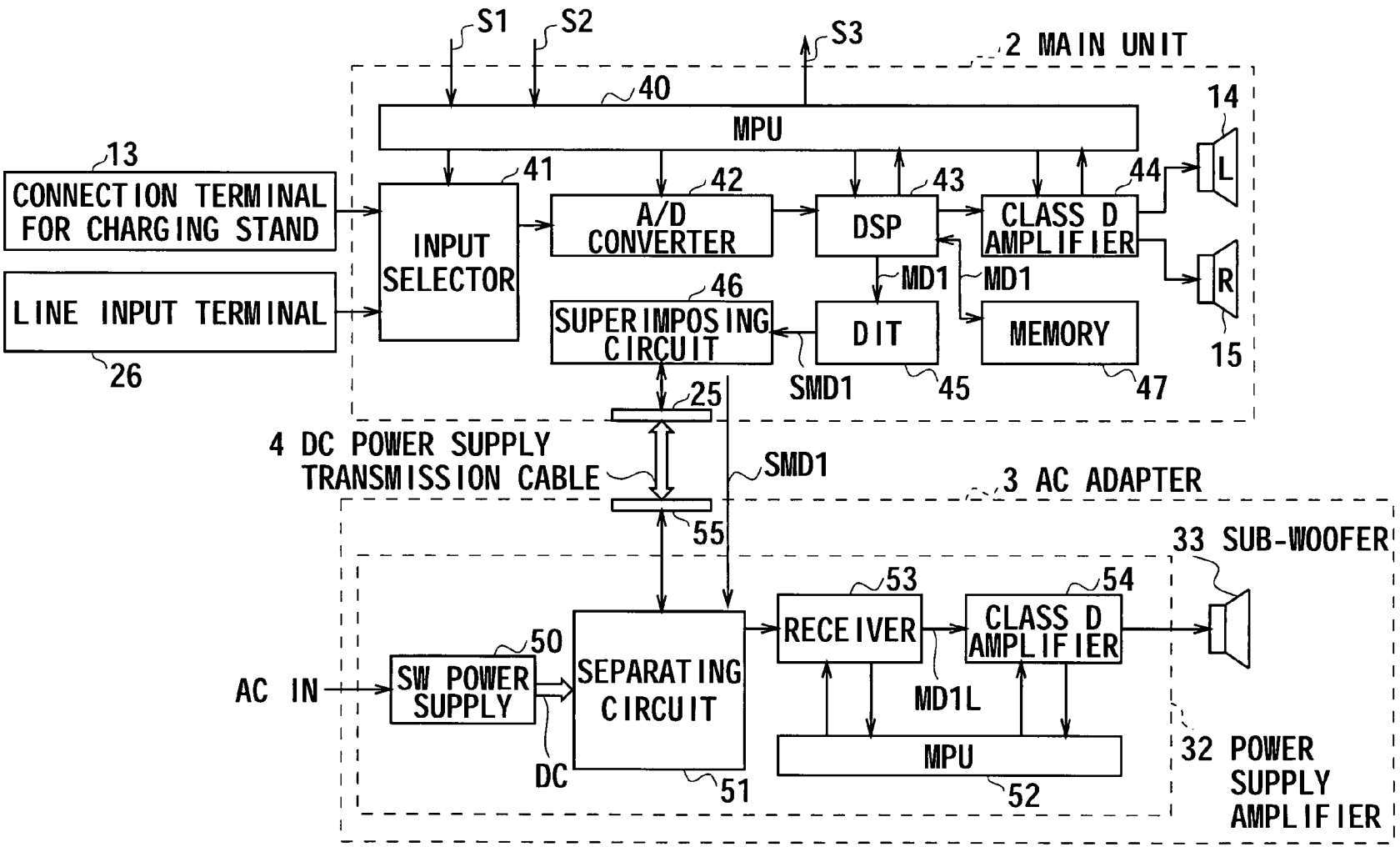
FIG. 5 is a schematic block diagram showing a circuit configuration of the main unit and an AC adapter.

Next, the circuit configuration of the main unit 2 and the AC adapter 3 will be described by using FIG. 5. The main unit 2 controls the entire system by an Micro Processing Unit (MPU) 40, and is adapted to operate the entire system based on a DC power DC supplied from the AC adapter 3 through the DC power supply transmission cable 4.

This main unit 2 inputs the music signal supplied from the portable telephone with music reproducing function 6 connected through the connection terminal for charging stand 13 to an input selector 41 and also inputs the music data supplied from the external electronic apparatus connected through the line input terminal 26 to the input selector 41.

The input selector 41 preferentially selects the music signal supplied as default from the portable telephone with music reproducing function 6 through the connection terminal for charging stand 13, and sends the music signal to an Analog/Digital (A/D) converter 42.

Incidentally, the MPU 40 of the main unit 2 is adapted to select preferentially the music signal supplied from the external electronic apparatus based on a key signal S1 inputted according to a user's pressing operation with respect to a function key 16 and send the music signal supplied from the external electronic apparatus to the A/D converter 42. That is, the main unit 2 can selectively switch any of the music signal from the portable telephone with music reproducing function 6 or the music signal from the external electronic apparatus according to the user's pressing operation with respect to the function switch 16.

The A/D converter 42 converts the audio signal into digital music data MD1 and sends the music data MD1 to a digital signal processor 43. The digital signal processor 43 performs predetermined digital signal processing to the music data MD1 and sends the thus processed music data MD1 to a class D amplifier 44 and a digital interface transmitter 45.

The class D amplifier 44 performs an amplifying process to the digital signal processed music data MD1. The class D amplifier 44 then outputs the thus obtained sounds according to the left channel music signal and right channel music signal from the left speaker 14 and the right speaker 15.

The digital interface transmitter 45 converts the digital signal processed music data MD1 into serial data format music data SMD1 and sends the serial data format music data SMD1 to a superimposing circuit 46.

Incidentally, the MPU 40 of the main unit 2 is adapted to regulate the sound volume level of the music or sound data MD1 outputted from the digital signal processor 43 based on a control signal S2 inputted corresponding to the user's pressing operation with respect to the volume up button 17 and the volume down button 18.

Note that, the MPU 40 of the main unit 2 outputs an LED control signal S3 according to the operating state of the main unit 2. Thereby, the MPU 40 of the main unit 2 can control to light the power display LED 19, the line-in display LED 20 and the surround display LED 21.

On the other hand, the AC adapter 3 inputs the AC power of AC100 V supplied from a commercial AC power supply to a switching (SW) power supply circuit 50 of the power supply amplifier 32. The SW power supply circuit 50 converts the AC power of AC100 V into a DC power DC of DC12 V. Then, the SW power supply circuit 50 supplies the DC power DC of DC12 V to an MPU 52, a receiver 53 and a class D amplifier 54 through a separating circuit 51.

Further, the AC adapter 3 supplies a DC power supply current of DC12 V supplied from the SW power supply circuit 50 to the main unit 2, from a DC terminal 55 through the DC power supply transmission cable 4 and the DC input terminal 25 through the separating circuit 51. Thus, the AC adapter 3 can charge the portable telephone with music reproducing function 6 through the connection terminal for charging stand 13.

Incidentally, the main unit 2 receives the DC current from the AC adapter 3 through the DC power supply transmission cable 4. On the other hand, the main unit 2 superimposes the music data SMD1 on the DC current by the superimposing circuit 46 and transmits the music data SMD1 to the AC adapter 3.

Figure 6:
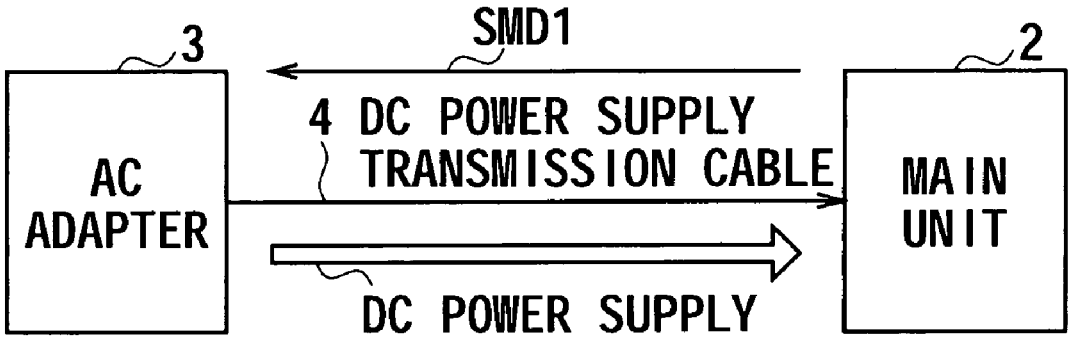
FIG. 6 is a schematic view provided to explain the superimposition of music data to a DC power supply transmission cable.

In this case, as shown in FIG. 6, the main unit 2 transmits the music data SMD1 through the DC power supply transmission cable 4. Then, the AC adapter 3 inputs the music data SMD1 transmitted through the DC power supply transmission cable 4 to the separating circuit 51.

As described above, the AC adapter 3 is adapted to be able to receive the music data SMD1 from the main unit 2 through the DC power supply transmission cable 4. Thus, the AC adapter 3 separates the DC current and the music data SMD1 by the separating circuit 51, extracts only the music data SMD1 and then sends the music data SMD1 to the receiver 53.

The receiver 53 demodulates the music data SMD1 to restore the original music data MD1. The receiver 53 filters only a low-frequency component from the restored music data MD1 to obtain the low range components MD1L of the music data MD1 and sends the low range components MD1L to the class D amplifier 54. The class D amplifier 54 amplifies the low range components MD1L and outputs a low-pitched sound in accordance with the low range components MD1L through the sub-woofer 33.

Further, them an unit 2 performs the digital signal processing of the music data MD1 reproduced and supplied from the portable telephone with music reproducing function 6 by the digital signal processor 43. Then, the main unit 2 stores the thus processed music data MD1 in a memory 47. Thus, the main unit 2 can read the music data MD1 from the memory 47 and output the sound according to the music data MD1 from the left speaker 14 and the right speaker 15 through the class D amplifier 44.

As described above, the main unit 2 can store many types of music data MD1 in the memory 47, reproduce the music data MD1, and output the music data MD1 from the left speaker 14 and the right speaker 15. Accordingly, even if the portable telephone with music reproducing function 6 is not connected, the main unit 2 itself can become a reproducing means and sound output means of the music data MD1.

Further, in the main unit 2, the MPU 40 can detect a call existed in the portable telephone with music reproducing function 6 through the connection terminal for charging stand 13. When the call in the portable telephone with music reproducing function 6 is detected while the music data MD1 is reproduced and outputted from the left speaker 14 and the right speaker 15, the main unit 2 is adapted to forcibly lower the sound volume level of the music data MD1 through the digital signal processor 43 and output the calling sound from the left speaker 14 and the right speaker 15.

Then, the main unit 2 is shifted to a hands-free state. After the incoming sound is outputted, the main unit 2 outputs sound of the other party from the left speaker 14 and the right speaker 15.

(5) Operation and Effect

In the configuration described above, the acoustic system 1 outputs the mid-high range audio sound corresponding to the music data MD1 reproduced by the portable telephone with music reproducing function 6 connected through the connection terminal for charging stand 13 from the left speaker 14 and right speaker 15. The main unit 2 can output the low range audio sound corresponding to the music data MD1 from the sub-woofer 33 of the AC adapter 3. Accordingly, the low range audio sound which cannot be outputted only from the left speaker 14 and the right speaker 15 can be sufficiently covered by the sub-woofer 33.

At this time, the acoustic system 1 can provide a richly expressive acoustic environment from the low range audio sound to the mid-high range audio sound without allowing a user to feel the presence of the sub-woofer 33 in appearance by arranging the main unit 2 mounting the left speaker 14 and the right speaker 15 on the table, for example, and installing the AC adapter 3 concealed in the sub-woofer 33 within the body 31 under a table.

Particularly, since the AC adapter 3 is adapted to output only the low range audio sound with no directivity from the sub-woofer 33, the sub-woofer 33 can be concealed in the body 31. Thus, the AC adapter 3 can allow the user to feel as if the sound from the low range to the mid-high range is outputted to the user only from the left speaker 14 and the right speaker 15 of the main unit 2.

Incidentally, the AC adapter 3 can output only the sound of the low range component MD1L tuned by the port 35. Further, the sub-woofer 33 is entirely covered by the body 31. Accordingly, even if the mid-high range audio sound which cannot be filtered by the digital filtering is outputted, the mid-high range audio sound hardly leak from the body 31 to the outside. Only the low range audio sound can be outputted certainly by the mechanical filtering configuration.

Furthermore, the acoustic system 1 not only can supply the DC power DC from the AC adapter 3 to the main unit 2 by the DC power supply transmission cable 4 of the power supply line, but also can transmit the music data SMD1 from the main unit 2 to the AC adapter 3. Thus, the entire configuration of the acoustic system 1 can be simplified without necessity of providing the power supply line for the DC power DC and the signal line for the music data SMD1.

Accordingly, the acoustic system 1 can connect the main unit 2 to the AC adapter 3 by the general-purpose DC power supply transmission cable 4. Therefore, a general AC adapter 3 (not shown) which does not carry the sub-woofer 33 can be connected by the DC power supply transmission cable 4 without using the AC adapter 3 according to one embodiment of the present invention. Thus, the usability of the acoustic system 1 can be further improved.

According to the configuration described above, the acoustic system 1 can output the mid-high range audio sound by the left speaker 14 and the right speaker 15 of the main unit 2 as well as the low range audio sound by the sub-woofer 33 built in the main unit 2 in concealing manner. Accordingly, the richly expressive listening environment can be provided without increasing the size of the main unit 2 by the sub-woofer 33 and without letting the user aware of the presence of the sub-woofer 33.

(6) Other Embodiments

Incidentally, in the above-mentioned embodiments, there has been described the case that the sound based on the music signal reproduced by the portable telephone with music reproducing function 6 is outputted from the left speaker 14 and the right speaker 15 of the main unit 2 and the sub-woofer 33 of the AC adapter 3. However, the present invention is not limited to this. The sound of a music signal or a radio program reproduced by the electronic apparatus, such as a semiconductor memory built-in type or hard disk-built in type portable audio player, a Personal Digital Assistant (PDA), etc., may be outputted from the left speaker 14 and the right speaker 15 of the main unit 2 and the sub-woofer 33 of the AC adapter 3.

Further, in the above-mentioned embodiments, there has been described the case that the left speaker 14 and the right speaker 15 are provided for the main unit 2 in the acoustic system 1 of 2.1 channel and the one sub-woofer 33 is provided in the AC adapter 3. However, the present invention is not limited to this. Two or more speakers may be provided for the main unit 2, or a plurality of sub-woofers may be provided in the AC adapter 3.

Furthermore, in the above-mentioned embodiments, there has been described the case that the main unit 2 having the charging stand 12 is used as a main unit. However, the present invention is not limited to this. As the main unit, an electronic apparatus, such as a notebook-sized personal computer, a PDA or the like may be used. Even in this case, in addition to the sound outputted from the speaker of the notebook-sized personal computer or the PDA, the low range audio sound can be outputted by the sub-woofer 33 of the AC adapter 3. Accordingly, the richly expressive acoustic space in which the low range audio sound is sufficiently outputted, can be provided.

Moreover, in the above-mentioned embodiments, there has been described the case that as the power adapter, the AC adapter 3 is used. However, the present invention is not limited to this. As the power adapter, a DC/DC adapter for supplying the DC power of the predetermined voltage level may be used for the main unit 2.

Further, in the above-mentioned embodiments, there has been described the case that the main unit 2 connects the external electronic apparatus through the line input terminal 26 and the music signal is inputted from the external electronic apparatus. However, the present invention is not limited to this. The music signal may be inputted through a memory stick (Registered Trademark of Sony Corporation) attachable to/detachable from the main unit 2 or a Universal Serial Bus (USB) memory.

The acoustic system of the present invention can be applied to a component system which uses, for example, a small speaker in which the low range audio sound is often insufficient.

It should be understood by those skilled in the art that various modifications, combinations, sub-combinations and alterations may occur depending on design requirements and other factors insofar as they are within the scope of the appended claims or the equivalents thereof.

What is claimed is:

1. An acoustic system comprising:

a power supply adapter comprising a power supply unit, an amplifier, and a woofer unit which outputs a low range audio sound according to an audio signal;

a main unit comprising a micro processing unit (MPU), speaker units which output a mid-high range audio sound according to the audio signal, and a connection terminal for electrically connecting a predetermined electronic apparatus capable of receiving calls and reproducing an audio signal indicating receipt of a call, the MPU being configured to control the power supply unit, the woofer unit, and the speaker units based on a DC power supplied from the power supply adapter, wherein a single housing independent of a display unit encloses the main unit, including the speaker units, the single housing having the connection terminal centrally arranged on a front surface to directly connect to the predetermined electronic apparatus and a plurality of buttons that control the acoustic system arranged on a top surface; and a transmission cable which connects the power supply adapter to the main unit and transmits the audio signal to the power supply adapter from the main unit to output the low range audio sound from the woofer unit, wherein the MPU is configured to automatically detect a call received by the predetermined electronic apparatus, lower a sound volume level being output by the speakers based on the detected call, and output the audio signal indicating receipt of the call received by the predetermined electronic apparatus via the speakers, the MPU is further configured to receive a digital signal from the predetermined electronic apparatus and transmit the digital signal to the power supply adapter via the transmission cable, and the power supply adapter is configured to amplify the received digital signal at the amplifier and output low range audio via the woofer unit according to the digital signal.

2. The acoustic system according to claim 1, wherein the power supply unit supplies the DC power to the main unit and the power supply adapter includes the amplifier for driving the woofer unit.

3. The acoustic system according to claim 1, wherein the main unit outputs the mid-high range audio sound according to the audio signal supplied from the electronic apparatus connected through the connection terminal from the speaker units, and transmits the audio signal for outputting the low range audio sound according to the audio signal from the woofer unit of the power supply adapter to the power supply adapter through the transmission cable.

4. The acoustic system according to claim 3, wherein the main unit supplies and charges power to the electronic apparatus if the electronic apparatus is connected through the connection terminal.

5. The acoustic system according to claim 3, wherein the predetermined electronic apparatus is a portable telephone.

6. The acoustic system according to claim 3, wherein the main unit includes a first input for receiving a key signal and a second input for electrically connecting an external electronic apparatus, wherein the MPU selects an audio signal from one of the predetermined electronic apparatus and the external electronic apparatus to be outputted based on the inputted key signal.

7. The acoustic system according to claim 1, wherein the transmission cable is a DC power supply transmission cable, the power supply unit is an AC adapter, and supplies the DC power of a predetermined voltage level converted from a commercial AC power to the main unit through the DC power supply transmission cable, and the main unit superimposes the audio signal through the DC power supply transmission cable and transmits the audio signal to the power supply adapter.

8. The acoustic system according to claim 1, wherein the main unit includes an amplifier for driving the speaker units.

9. The acoustic system according to claim 1, wherein the power supply adapter is made of a housing such that the woofer unit is concealed.

10. The acoustic system according to claim 1, wherein the MPU is further configured to output audio of the received call via the speakers after the audio signal indicating the receipt of the call is output.

11. The acoustic system according to claim 9, wherein the housing is of a quadrangular prism shape having a trapezoidal cross section.

12. The acoustic system according to claim 1, wherein the main unit further comprises a light receiving unit to receive infrared light from a separate remote controller to control the acoustic system and the light receiving unit is arranged on the front surface of the single housing.

13. The acoustic system according to claim 1, wherein the single housing includes a semicircular portion extending from the front surface and the connection terminal is located on a top surface of the semicircular portion such that when the predetermined electronic apparatus is connected to the main unit, the predetermined electronic apparatus is controllable by the user.

* * * * *